United States Patent [19]

Snaper et al.

[11] Patent Number: 4,986,531

[45] Date of Patent: Jan. 22, 1991

[54] WATER-ACTUATED NOVELTY

[76] Inventors: Alvin A. Snaper, 2800 Cameo Cir., Las Vegas, Nev. 89107; Merrill Heatter, 1011 N. Roxbury Dr., Beverly Hills, Calif. 90210

[21] Appl. No.: 452,837

[22] Filed: Dec. 19, 1989

[51] Int. Cl.[5] ..... A63G 5/00

[52] U.S. Cl. ..... 272/27 N; 272/27 R; 272/8 N; 40/407

[58] Field of Search ..... 272/8 N, 8 R, 27 N, 272/27 R; 40/406, 407

[56] References Cited

U.S. PATENT DOCUMENTS

| | | | |
|---|---|---|---|
| 3,586,320 | 6/1971 | Mace | 272/27 N |
| 3,997,991 | 12/1976 | Hayman-Chaffey et al. | 40/361 |
| 4,903,424 | 2/1990 | Satoh et al. | 272/8 N X |
| 4,903,958 | 2/1990 | DiCarlo et al. | 272/27 N |

*Primary Examiner*—Richard E. Chilcot, Jr.
*Attorney, Agent, or Firm*—Donald D. Mon

[57] ABSTRACT

A novelty format in which a compressed dry stored material is expanded by addition of water. It is supported by a telescopic array of rods and a sleeve to limit bending of the wetted material. It can be made to simulate various objects such as a stalk or stem, and may carry greetings which rise with the expansion of the material when the material is wetted with water.

10 Claims, 2 Drawing Sheets

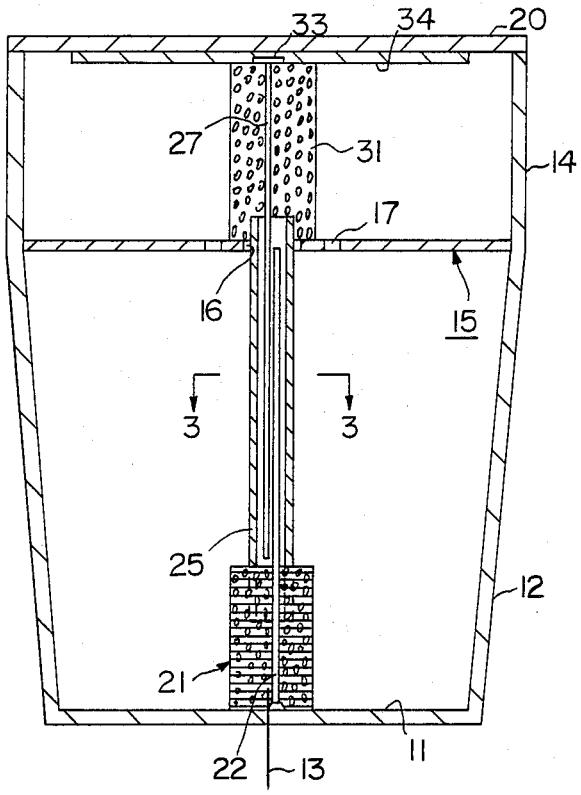
FIG.1
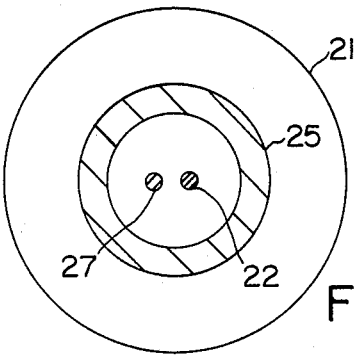
FIG.3
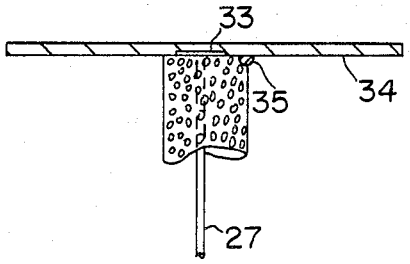
FIG.4
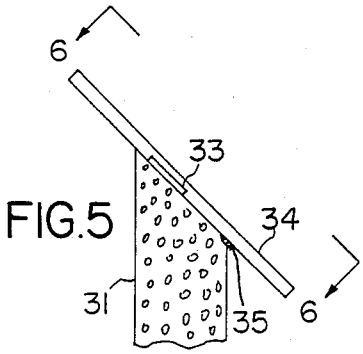
FIG.5
FIG.6
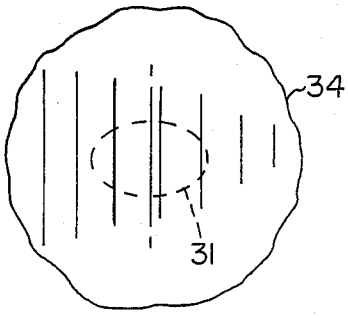

WATER-ACTUATED NOVELTY

FIELD OF THE INVENTION

This invention relates to a water-actuated novelty, and in particular to a novelty which from a smaller stored configuration expands to create a larger display, such as a greeting.

BACKGROUND OF THE INVENTION

The novelty field requires a seemingly-endless supply of presentations and devices which provide surprise or amusement when opened or operated. It is known to provide greeting cards and childrens's books which have a plurality of planar sheets that are moved in-plane relative to one another to provide changed display configurations. Pop-up folded constructions are also known. While many of these are of great amusement to their recipients, in general they rely for their novelty on the printed subject matter, or on the shape of the folded structures. While the variety of these devices is theoretically limited only by the capacity of the human mind to think up new slogans or presentations, still the attainable variety is inherently limited by the format of its presentation.

What is ultimately of greater importance than a new printed or shaped message is a novel and different structural format in which to deliver a message, thereby making available an entirely new range or array of attainable messages and presentations. It is an object of this invention to provide a new structural format.

The format provided by this invention involves volumetric growth from a lesser stored volume to a larger expanded volume. The volume of the format itself increases. This is not a mere unfolding type linear enlargement. As a consequence of its construction, the enlarged displayed construction can take a shape that simulates a known structure such as a flower stalk, for example. Furthermore, the change in volume can be accomplished by means analogous to real-life procedures such as the watering of a pot to produce a flower stalk.

This invention involves the use of a dried, compressed material which expands upon the application of water to form a sponge-like cellular structure. The compressed structure can initially be shaped so that upon expansion it assumes a desired configuration.

Compressed sponges which expand upon addition of water are known. What also is known is that especially when the material is a cellulose, the expanded material while wet has only negligible structural strength. Accordingly, While it is possible to provide - block or a ball as an expanded shape, and expect it to maintain its shape, the same cannot be said of any such structure whose orthogonal dimensions differ much from one another. The structural properties of the wet expanded product are a limiting parameter on what can be accomplished as a "growing" novelty which utilizes such a material.

It is an object of this invention to provide a water-actuated novelty which is initially compressed and which, when water is applied, can lengthen along one of its axes to an appreciable degree while still retaining a configuration respective to an elongated structure such as a flower stalk.

It is a further object of this invention to provide this structure in such a configuration that its visible portion after expansion is considerably more elongated than could be supported by a base-mounted reinforcement.

BRIEF DESCRIPTION OF THE INVENTION

A novelty according to this invention has a central growth axis, a base, and a lateral restraint axially spaced from the base. The objective is to provide a substantial axial growth above the lateral restraint.

A sleeve is fitted in the lateral support so it can slide axially in the lateral restraint, but is restrained against lateral movement. A first support rod is fixed to the base, and is freely slidable in the sleeve. It is supported against lateral movement by the sleeve. A second support rod is also slideably fitted in the sleeve.

The two support rods and the sleeve are telescopically associated in the sense that as a group their assembled length can be compressed to a minimum length and expanded to a maximum length, and while they overlap one another they provide physical constraint to limit the bending of a material surrounding them.

A first linearly expansible capsule is fixed to the base. The sleeve is fixed to the first capsule. The first support rod is fixed to the base and freely passes through the first capsule, into the sleeve.

A second linearly expansible capsule has its first end fixed to the lateral restraint. The sleeve enters the second capsule. The second support rod extends from the second end of the second capsule into the sleeve.

When the capsules are dry and compressed, they occupy a minimum axial length and the rods and sleeve are telescoped closely together. When water is applied to the capsules, both capsules elongate axially. Because they will usually be punched out of compressed material there will be only a small lateral growth.

The first capsule boosts the sleeve, and the sleeve moves axially above the restraint to provide lateral support for the second rod, which in turn has extended appreciably relative to both the restraint and the sleeve. As a consequence there is generated an axially stable extended structure of exposed material which except for the support of the rods and the sleeve would have only minimal bending strength.

According to a preferred but optional feature of this invention, the base and lateral restraint form portions of a container, and the container includes a peripheral rim which surrounds the second capsule. A message element is mounted to the second end of the second capsule, which can have any desired shape such as that of a flower, and can bear a message. A removable cover across the rim can conceal the second capsule and any message.

Perforations in the restraint means enable water poured onto the restraint means to flow to the first capsule.

The above and other features of this invention will be fully understood from the following detailed description and the accompanying drawings, in which:

BRIEF DESCRIPTION OF THE DRAWINGS

FIG. 1 is an axial cross-section of the presently-preferred embodiment of the invention, in its initial compressed and un-actuated condition;

FIG. 3 is a cross-section taken at line 3—3 in FIG. 1;

FIG. 4 is an enlarged section showing a modification of FIG. 1 in its initial compressed and un-actuated condition:

FIG. 5 shows the feature of FIG. 4 in its actuated condition; and FIG. 6 is a view taken at line 6—6 in FIG. 5.

DETAILED DESCRIPTION OF THE INVENTION

Figure 2:
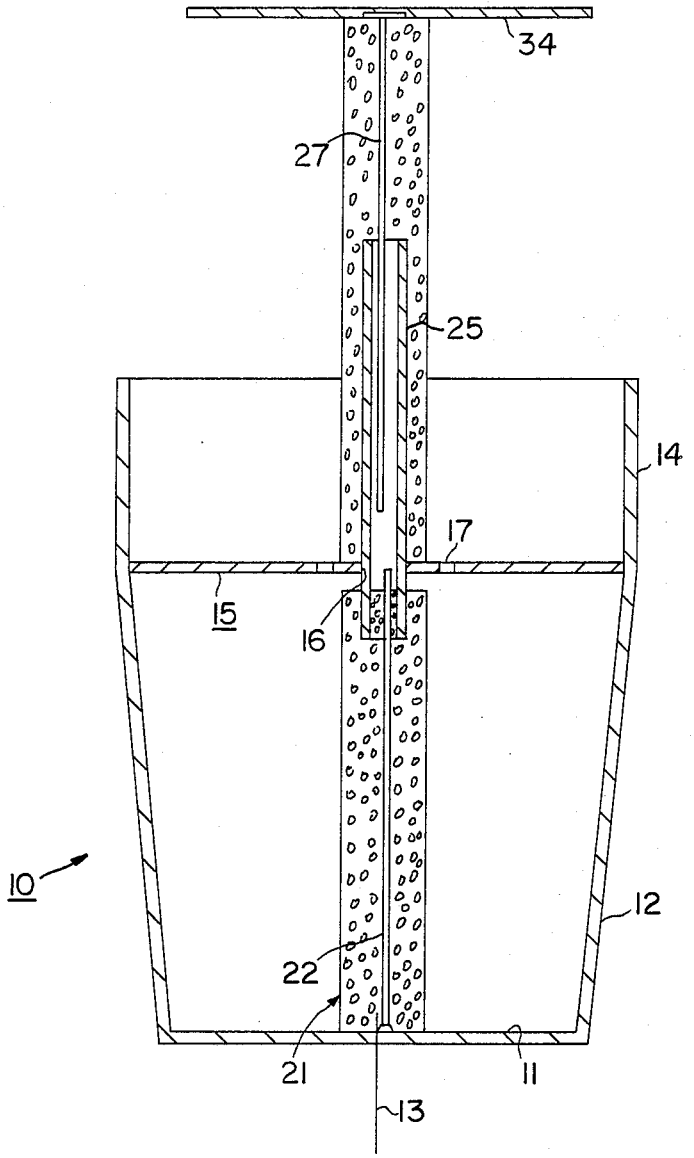
FIG. 2 is an axial cross-section of the novelty of FIG. 1 in its actuated condition.

A novelty 10 according to this invention is shown in FIG. 1. The illustrated device is intended to "grow" when watered to simulate the stalk or stem of a flower or plant, and to have an exposed length very much longer than which would be self-supporting when wet.

Novelty 10 has a base 11 and a peripheral side wall 12. It has a central axis 13. A peripheral rim 14 forms an upper continuation of the side wall. The total intended effect is that of a flower pot.

A lateral restraint 15 extends across the side wall where it joins the rim. It is intended for this restraint to act as a spider, with a central aperture 16. For best effect for a novelty, the restraint will be disc-like, and perforated only by aperture 16 and a plurality of holes 17 which enable water to pass through the restraint toward the base.

A removable cover 20, perhaps paper or foil, is cemented to the top of the rim to conceal the contents of the container. The cover is optional.

A first linearly expansible capsule 21 is fixed to the base, conveniently by cementing it to the base. Its physical properties will be disclosed later. It is a compressed and dry article with an axis of expansion coaxial with axis 13.

A first support rod 22 is fixed to the base, preferably by the same cement which affixes the first capsule to the base. It is preferably made of a stiff wire such as piano wire, for its lateral restraining properties, primarily a resistance to bending. It passes through the first capsule and projects upwardly into a tubular sleeve 25. It is freely slidable in the sleeve.

The sleeve is stiff. It may be of stiff organic plastic, or of metal as preferred. Also it need not be fully tubular. It could instead be any other type of sliding linear guide and restraint such as rails, eyelets, or the like. Out-off lengths of tubing will usually be preferred for their lesser cost.

The sleeve is freely slidable in lateral restraint 15, but is side-supported by it. It is intended for the major portion of its length to be stored below the lateral restraint in the stored configuration, and to extend so the major portion of its length is above the lateral restraint in the actuated condition.

A second support rod 27 is telescopically fitted in the sleeve, and extends above it. It also is preferably made of stiff piano wire. A major portion of its length is below the lateral restraint in the stored configuration, and a major portion of its length extends above it in the actuated condition.

As stated, the first expansible capsule 21 is fixed to the base, and the first support rod passes through it. The sleeve is seated in the upper end of the first capsule.

A second expansible capsule 31 is fixed to the lateral restraint. The sleeve is fitted in its lower end but can move along with the capsule material when it elongates, as will later be seen.

A flange 33 is formed on the upper end of the second rod, for example by bending the wire. This flange overlays the upper end of the second capsule and moves upwardly with it. It can serve as an attachment means for an "object" 84, such as a piece of cardboard bearing a greeting, and perhaps shaped to some configuration such as a flower.

The capsules are shown in FIGS. 1 and 4 in the unactuated condition.

The growth of the capsule material after application of water is shown in FIG. 2. Of interest as a novelty, a dab 35 of cement may be applied to the dry second capsule and to the object at a point. This is shown in FIG. 4. When expansion occurs, expansion will be lessened where the cement is, and a tilted display will result as shown in FIG. 5.

Any material which expands upon the application of water is suitable for the capsules. The presently-preferred material is a compressed porous regenerated cellulose sponge. Suitable examples are O-CEL-O Sponge F 11, F 12, and F 13 sold by O-CEL-O, General Mills, Inc., of Tonawanda, New York 14150. It can be compressed dry to a relatively small volume, and will swell appreciably When water is applied to it. In the small cross-sections such as are proposed to be used in novelties, it has little bending strength. This is the reason for the supports.

Interesting variations are attainable with this novelty. For example, the wetted capsule material can be used as a battery to provide electrical current to illuminate something on the device. For this purpose an electrolyte can be incorporated in the sponge material before drying and compressing it. Then other battery components (not shown), will be added as appropriate.

Also, should fragrance be desired, a micro-encapsulated fragrance will be incorporated in the capsule material before compression, so as to be released upon being wetted.

The operation of this novelty is straight-forward. When it is to be used, the cover is removed. Water is applied to both capsules, perhaps from a toy watering pot. Water for the first capsule will flow through the lateral restraint, and fall on the lower capsule.

Both capsules expand, primarily in axial elongation. Notice in FIG. 5 that the elongation of the lower capsule serves to drive the sleeve upwardly so that it provides a significant length of lateral support for the upper second capsule material. The sleeve is side supported by the lateral restraint.

The second capsule material rises substantially above the upper end of the sleeve, drawing the second rod upwardly. The second rod is side supported at its lower end by the sleeve. The clearances in the structure are exaggerated for purposes of disclosure. It will be seen that the elongated telescopic array of the two rods and the sleeve give substantial support against bending of the elongated material above the lateral restraint. There will usually be some bending, of course, but when a flower stalk is simulated, this is both acceptable and agreeable.

As an example, an elongated length above the lateral restraint of about $6\frac{1}{2}$ inches with a $\frac{3}{8}$ inches diameter from a dry second capsule initially about $\frac{3}{4}$ inches high above the lateral restraint. The elongated material appears like a flower stalk and is held suitably upright while wet. When the water evaporates, the material becomes relatively hard, and the restraint then is only for the purpose of keeping it centered. Bending is no longer likely.

The variation of FIGS. 4–6 causes the object to tilt by restraining expansion at one point around the periphery.

This invention provides a new format for novelties, at a modest cost. It is adaptable to deliver various messages. The periphery of the material can be shaped other than circular by appropriately shaping the stored capsule. Square and star-shaped sections are examples.

This invention is not to be limited by the embodiments shown in the drawings and described in the description which are given by way of example and not of limitation, but only in accordance with the scope of the appended claims.

I claim:

1. A novelty adapted to be stored in a dry reduced format and expanded to form a larger display upon addition of water, comprising:

a base, the novelty having a central axis rising from said base;

a first rod fixed to said base;

a lateral restraint structurally connected to said base above the base, said restraint having an aperture therethrough on said central axis;

a sleeve slidably fitted in said aperture;

a second rod, both of said rods extending axially and telescopically fitted to said sleeve;

a first capsule fixed to said base, said sleeve being mounted to the upper end of said first capsule, said rod passing through said first capsule;

a second capsule fixed to said lateral restraint, said sleeve being fitted in the lower end of said second capsule, said second rod passing through said second capsule from its top;

said capsules being formed of a dried, compressed material which upon application of water to it swells so as to elongate along said axis, said first capsule moving said sleeve in the lateral restraint to extend farther above said lateral restraint, said second rod rising with the upper end of the second capsule, the telescopic engagement of the rods and sleeve, and the fitting of the sleeve on the lateral restraint, enabling the axial elongation to occur while providing support against excessive bending of the wetted second capsule material.

2. A novelty according to claim 1 in which an object is attached to the upper and of the second capsule end of the second rod.

3. A novelty according to claim 2 in which said object is shaped to represent a subject.

4. A novelty according to claim 2 in which a small quantity of cement is applied to the upper edge of the second capsule and to the object to restrain the expansion of the second capsule material locally, whereby to tilt the object after the second capsule is wetted.

5. A novelty according to claim 1 in which a peripheral rim surrounds and rises above the lateral restraint, said rim having an upper end, and in which a cover is removably attached to said upper edge of the rim.

6. A novelty according to claim 1 in which said lateral restraint is disc-like.

7. A novelty according to claim 6 in which the base and lateral restraint are joined by a peripheral wall in which the first capsule is located.

8. A novelty according to claim 1 in which an electrolyte is incorporated into the dry capsule to act as part of a battery when the capsules are wetted.

9. A novelty according to claim I in which a fragrance is incorporated into the material of the dried capsules.

10. A novelty according to claim 1 in which the capsules are made of a dried, compressed cellulosic cellular sponge.

* * * * *